US010465541B2

(12) United States Patent
Feigleson

(10) Patent No.: US 10,465,541 B2
(45) Date of Patent: Nov. 5, 2019

(54) GAS TURBINE ENGINE STATOR VANE ASSEMBLY WITH SPLIT SHROUD

(71) Applicant: UNITED TECHNOLOGIES CORPORATION, Hartford, CT (US)

(72) Inventor: Steven J. Feigleson, Falmouth, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 406 days.

(21) Appl. No.: 14/770,164

(22) PCT Filed: Mar. 12, 2014

(86) PCT No.: PCT/US2014/024642
§ 371 (c)(1),
(2) Date: Aug. 25, 2015

(87) PCT Pub. No.: WO2014/150954
PCT Pub. Date: Sep. 25, 2014

(65) Prior Publication Data

US 2016/0003075 A1 Jan. 7, 2016

Related U.S. Application Data

(60) Provisional application No. 61/786,932, filed on Mar. 15, 2013.

(51) Int. Cl.

| | |
|---|---|
| ***F01D 9/04*** | (2006.01) |
| ***F01D 11/04*** | (2006.01) |
| ***F01D 25/04*** | (2006.01) |
| ***F01D 11/00*** | (2006.01) |

(52) U.S. Cl.
CPC ..... *F01D 9/044* (2013.01); *F01D 9/042* (2013.01); *F01D 11/005* (2013.01); *F01D 25/04* (2013.01);
(Continued)

(58) Field of Classification Search
CPC ..... F01D 11/005; F01D 25/04; F01D 9/042; F01D 9/044; F05D 2220/32;
(Continued)

(56) References Cited

U.S. PATENT DOCUMENTS

| | | | |
|---|---|---|---|
| 5,074,749 | A | 12/1991 | Fouillot et al. |
| 6,425,736 | B1 | 7/2002 | McMahon et al. |

(Continued)

FOREIGN PATENT DOCUMENTS

| | | |
|---|---|---|
| EP | 1998006 | 5/2008 |
| EP | 1626163 | 12/2011 |
| EP | 1746259 | 4/2012 |

OTHER PUBLICATIONS

International Preliminary Report on Patentability for International Application No. PCT/US2014/024642 dated Sep. 24, 2015.

(Continued)

*Primary Examiner* — Mark A Laurenzi
*Assistant Examiner* — Paul W Thiede
(74) *Attorney, Agent, or Firm* — Carlson, Gaskey & Olds, P.C.

(57) ABSTRACT

A method of assembling gas turbine engine front architecture includes positioning a first shroud and a first shroud portion radially relative to one another. Multiple vanes are arranged circumferentially between the first shroud and the first shroud portion. A second shroud portion is secured to the first shroud portion about the vanes. The first and second shroud portions provide a second shroud. The vanes are mechanically isolated from the first and second shrouds.

21 Claims, 4 Drawing Sheets

(52) U.S. Cl.
CPC ..... *F05D 2220/32* (2013.01); *F05D 2230/23* (2013.01); *F05D 2230/60* (2013.01); *F05D 2240/11* (2013.01); *F05D 2240/12* (2013.01); *F05D 2300/437* (2013.01); *F05D 2300/501* (2013.01)

(58) Field of Classification Search
CPC ..... F05D 2230/23; F05D 2230/60; F05D 2240/11; F05D 2240/12; F05D 2300/437; F05D 2300/501
USPC ..... 415/209.3, 189
See application file for complete search history.

(56) References Cited

U.S. PATENT DOCUMENTS

| | | | |
|---|---|---|---|
| 6,543,995 | B1 | 4/2003 | Honda et al. |
| 8,328,512 | B2 | 12/2012 | Major et al. |
| 8,347,635 | B2 | 1/2013 | Durocher et al. |
| 2004/0033137 | A1 | 2/2004 | Glover et al. |
| 2010/0221115 | A1 | 9/2010 | Jardine et al. |
| 2012/0102735 | A1 | 5/2012 | Moreland |
| 2012/0189438 | A1 | 7/2012 | Feigleson et al. |
| 2012/0257963 | A1 | 10/2012 | Major et al. |
| 2013/0004306 | A1 | 1/2013 | Albers et al. |

OTHER PUBLICATIONS

Extended European Search Report for European Application No. 14769723.9 dated Nov. 21, 2016.
International Search Report and Written Opinion for PCT Application No. PCT/US2014/024642, dated Jun. 25, 2014.
EP Office Action for European Application No. 14769723.9 dated Jan. 26, 2018.

GAS TURBINE ENGINE STATOR VANE ASSEMBLY WITH SPLIT SHROUD

BACKGROUND

This disclosure relates to a gas turbine engine front architecture. More particularly, the disclosure relates to a stator vane assembly and a method of installing stators vanes within a front architecture.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

One type of gas turbine engine includes a core supported by a fan case. The core rotationally drives a fan within the fan case. Multiple circumferentially arranged stator vanes are supported at an inlet of the core by its front architecture.

The stator vanes are supported to limit displacement of the vane, and the vanes are subjected to vibratory stress by the supporting structure. That is, loads are transmitted through the front architecture to the stator vanes. Typically, the stator vanes are constructed from titanium, stainless steel or high grade aluminum, such as a 2618 alloy, to withstand the stresses to which the stator vanes are subjected.

Some front architectures support the stator vanes relative to inner and outer shrouds using rubber grommets. A fastening strap is wrapped around the circumferential array of stator vanes to provide mechanical retention of the stator vanes with respect to the shrouds. As a result, mechanical loads and vibration from the shrouds are transmitted to the stator vanes through the fastening strap.

SUMMARY

In one exemplary embodiment, a method of assembling gas turbine engine front architecture includes positioning a first shroud and a first shroud portion radially relative to one another. Multiple vanes are arranged circumferentially between the first shroud and the first shroud portion. A second shroud portion is secured to the first shroud portion about the vanes. The first and second shroud portions provide a second shroud. The vanes are mechanically isolated from the first and second shrouds.

In a further embodiment of the above, the first and second shrouds respectively correspond to inner and outer shrouds.

In a further embodiment of any of the above, the arranging step includes inserting the vanes into first and second slots respectively provided in the outer and inner shrouds. The arranging step also includes applying a liquid sealant around a perimeter of the vanes and at least one of the shrouds. Bonding and supporting the ends of vanes relative to one of the shrouds with the liquid sealant.

In a further embodiment of any of the above, each blade includes outer and inner perimeters respectively received in the first and second slots. The arranging step includes providing gaps between the outer and the inner perimeters and the outer and inner shrouds at their respective first and second slots. The applying step includes laying the liquid sealant about at least one of the inner and outer perimeters within their respective gaps.

In a further embodiment of any of the above, the inner perimeters are suspended relative to the inner shroud by the liquid sealant without direct contact between the vanes and the inner shroud.

In a further embodiment of any of the above, the outer perimeters are suspended relative to the outer shroud by the liquid sealant without direct contact between the vanes and the outer shroud.

In a further embodiment of any of the above, the gaps are maintained during the applying step.

In a further embodiment of any of the above, the liquid sealant is silicone rubber provided in one of a thicksotropic formulation or a room temperature vulcanization formulation. The liquid sealant provides a solid seal in a cured state.

In a further embodiment of any of the above, the securing step includes moving the second shroud portion axially and circumferentially with respect to the first shroud portion and fastening the first and second shroud portions to one another about the vanes.

In one exemplary embodiment, a gas turbine engine front architecture includes first and second shrouds. First and second walls have first and second slots respectively. One of the first and second shrouds including first and second shroud portions are secured to one another to provide its respective slot. Multiple stator vanes are circumferentially spaced from one another. Each of the stator vanes extends radially between the first and second shrouds and includes outer and inner perimeters respectively within the first and second slots.

In a further embodiment of any of the above, a flexible material is provided about the inner and the outer perimeters at the inner and the outer shrouds bonding the stator vanes to the inner and outer shrouds and separating the stator vanes mechanically from the inner and outer fairness.

In a further embodiment of any of the above, an inlet case includes first and second inlet flanges integrally joined by inlet vanes. The second and first shrouds correspond to outer and inner shrouds that are respectively fastened to the first and second inlet flanges. Multiple stator vanes are arranged upstream from the inlet vanes. The flexible material is a sealant.

In a further embodiment of any of the above, the outer shroud includes an attachment feature secured to the first inlet flange and a lip opposite the attachment feature. A splitter includes an annular groove supporting the lip.

In a further embodiment of any of the above, the splitter includes a projection facing each stator vane in close proximity to an edge of the outer end configured to prevent an undesired radial movement of the stator vanes.

In a further embodiment of any of the above, the first and second shroud portions are secured to one another by fasteners.

BRIEF DESCRIPTION OF THE DRAWINGS

The disclosure can be further understood by reference to the following detailed description when considered in connection with the accompanying drawings wherein.

DETAILED DESCRIPTION

Figure 1:
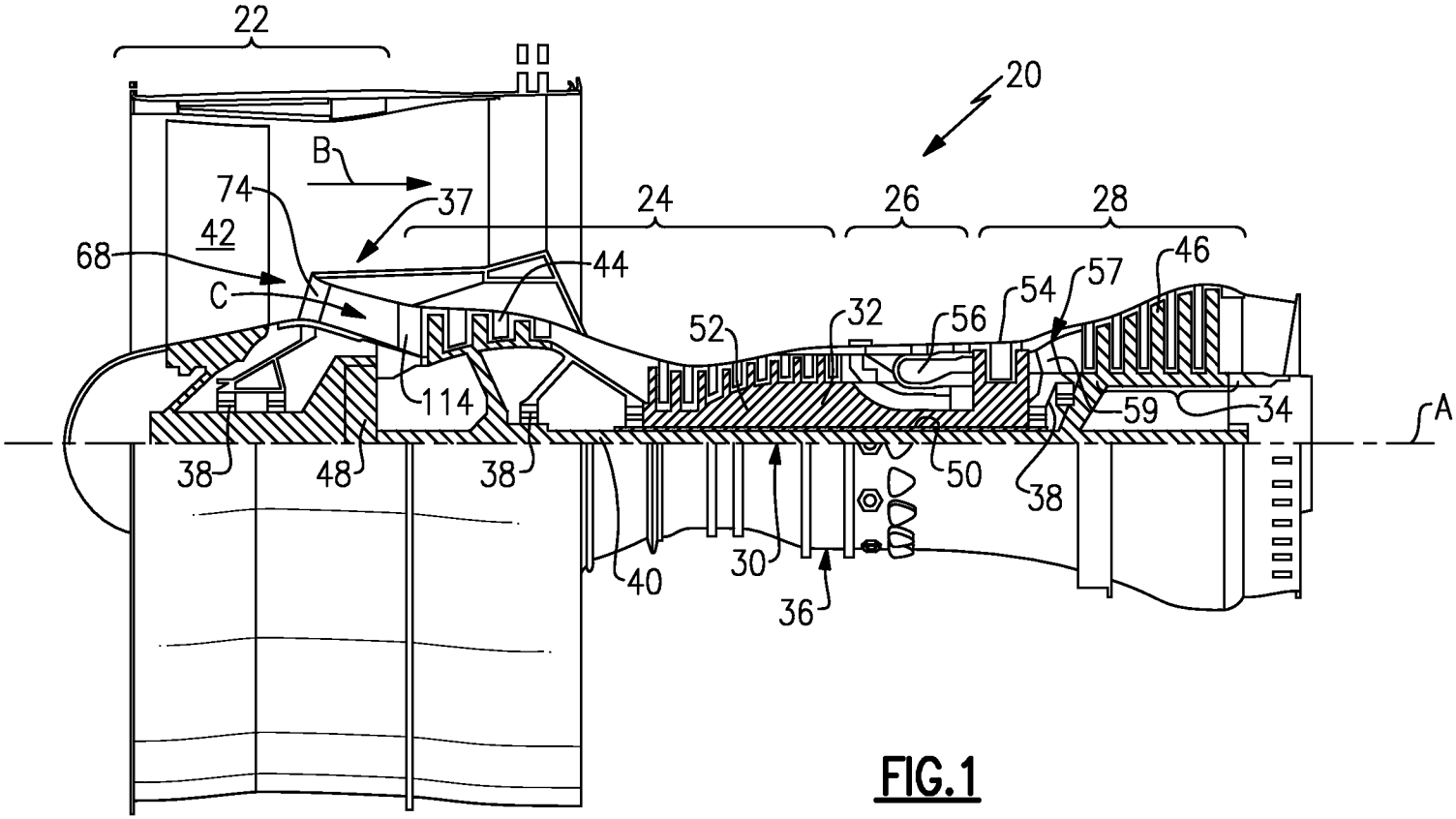
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 57 of the engine static structure 36 is arranged generally between the high pressure turbine 54 and the low pressure turbine 46. The mid-turbine frame 57 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 57 includes vanes 59, which are in the core airflow path and function as an inlet guide vane for the low pressure turbine 46. Utilizing the vane 59 of the mid-turbine frame 57 as the inlet guide vane for low pressure turbine 46 decreases the length of the low pressure turbine 46 without increasing the axial length of the mid-turbine frame 57. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\text{R})/518.7)^{0.5}]$. The "Low corrected fan tip speed", as disclosed herein according to one non-limiting embodiment, is less than about 1150 ft/second.

The engine static structure 36 includes a front architecture 37, having fixed structure, provided within the fan case 23 of the fan section 22 downstream from the fan 42. The front architecture 37 includes stator vanes 74 arranged upstream from inlet guide vanes 114, which are also arranged upstream from the first stage of the low pressure compressor section 44.

Figure 2:
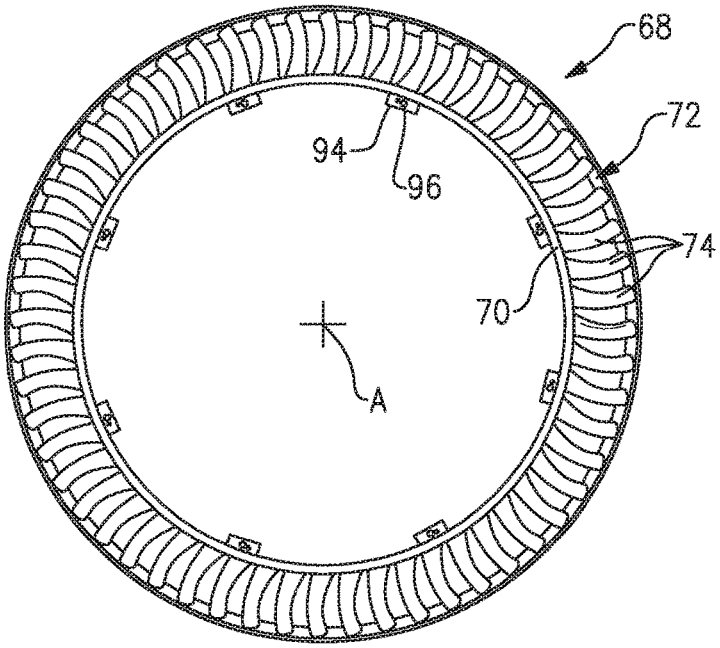
FIG. 2 is a front view of a stator vane assembly.
Figure 3:
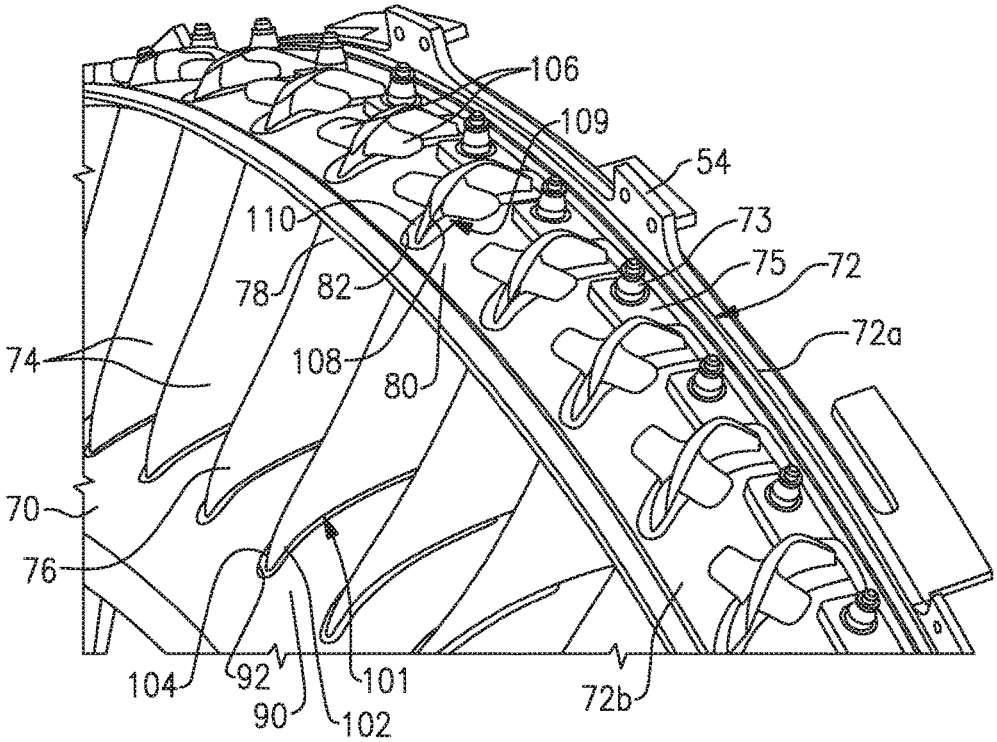
FIG. 3 is a perspective view of a portion of the stator vane assembly shown in FIG. 2.
Figure 4:
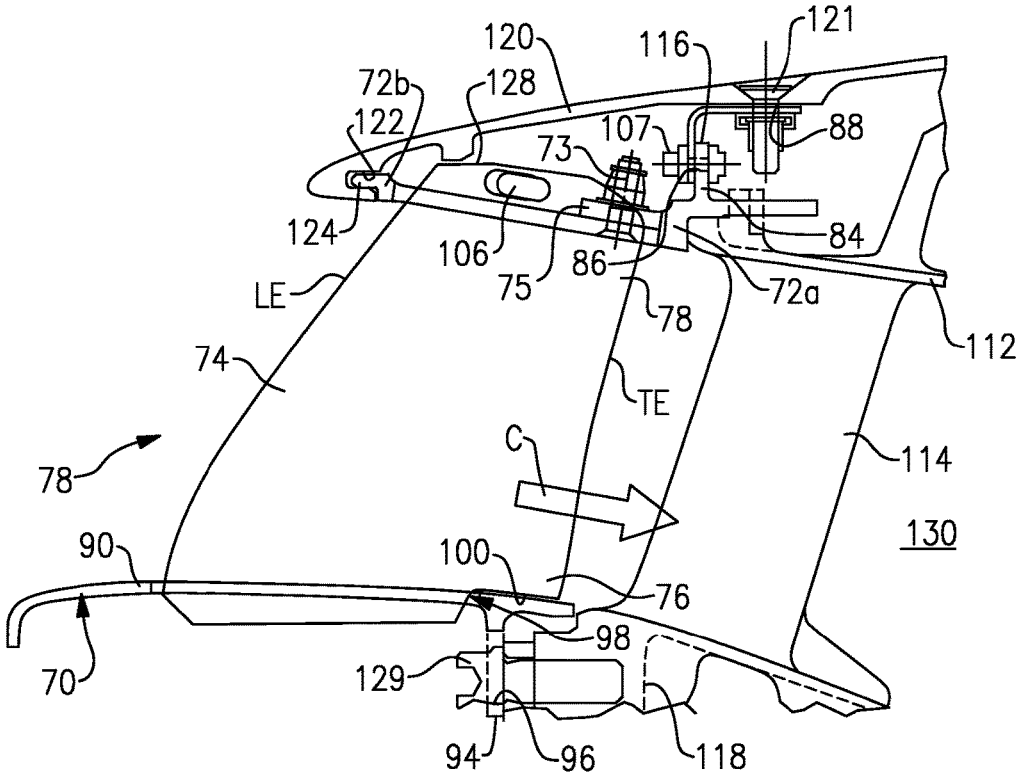
FIG. 4 is cross-sectional view of the stator vane assembly and surrounding engine static structure.

The front architecture 37 supports a stator vane assembly 68, which is shown in FIGS. 2-4. The stator vane assembly 68 includes inner and outer shrouds 70, 72 radially spaced from one another. Multiple stator vanes 74 are arranged circumferentially relative to one another about the axis A and extend between the inner and outer shrouds 70, 72. The stator vanes 74 provide an airfoil having opposing sides extending between leading and trailing edges LE, TE (FIG. 4).

Each stator vane 74 includes opposing inner and outer ends 76, 78. The outer shroud 72 has a first wall 80 that includes circumferential first slots 82 for receiving the outer ends 78 of the stator vane 74. A first flange 84 extends from the first wall 80, and a bracket 86 is secured to the first flange 84 by fasteners 88.

In the example shown in FIG. 3, the outer shroud 72 is provided by first and second shroud portions 72*a*, 72*b* that are secured to one another by fastening elements. In the example, the fastening elements are pin rivets; however, other fasteners may be used, such as solid rivets, flat head screws, or bolts and nuts. Tabs 75 extend axially from the first shroud portion 72*a* in the example and removably support the second shroud portion 72*b* during an assembly procedure.

The inner shroud 70 is provided by a second wall 90 that includes circumferentially arranged second slots 92 for receiving the inner ends 76 of the stator vanes 74. A second flange 94 extends from the second wall 90 and provides a third attachment feature or hole 96, best shown in FIG. 2.

Referring to FIG. 3, the inner ends 76 are secured relative to the inner shroud 70 within the second slots 92 with a liquid sealant 104 that provides a bonded joint. In one example, the liquid sealant is a silicone rubber having, for example, a thicksotropic formulation or a room temperature vulcanization formulation. The liquid sealant cures to a solid state subsequent to its application about an inner perimeter 102 at the inner shroud 70, providing a filleted joint.

The inner end 76 includes a notch 98 at a trailing edge TE (FIG. 4) providing an edge 100 that is in close proximity to the wall 90, as illustrated in FIG. 4, for example. The edge 100 provides an additional safeguard that prevents the stator vanes 74 from being forced inward through the inner shroud 70 during engine operation.

The stator vane 74 is supported relative to the inner shroud 70 such that a gap 101 is provided between the inner end 76 and the inner shroud 70 about the inner perimeter 102, as shown in FIG. 3. Said another way, a clearance is provided about the inner perimeter 102 within the second slot 92. The liquid sealant 104 is injected into the gap 101 to vibrationally isolate the inner end 76 from the inner shroud 70 during the engine operation and provide a seal.

The outer ends 78 are secured relative to the outer shroud 72 within the first slots 82 with the liquid sealant 110 that provides a bonded joint. The liquid sealant cures to a solid state subsequent to its application about the outer perimeter 108 at the outer shroud 72, providing a filleted joint.

The stator vane 74 is supported relative to the outer shroud 72 such that a gap 109 is provided between the outer end 78 and the outer shroud 72 about the outer perimeter 108. Said another way, a clearance is provided about the outer perimeter 108 within the first slot 82. The liquid sealant 110 is injected into the gap 109 to vibrationally isolate the outer end 78 from the outer shroud 72 during the engine operation and provide a seal.

The outer end 78 includes opposing, laterally extending tabs 106 arranged radially outwardly from the outer shroud 72 and spaced from the first wall 80. The tabs 106 also prevent the stator vanes 74 from being forced radially inward during engine operation. The liquid sealant is provided between the tabs 106 and the first wall 80.

The front architecture 37 is shown in more detail in FIG. 4. An inlet case 112 includes circumferentially arranged inlet vanes 114 radially extending between and integrally formed with first and second inlet flanges 116, 118. The inlet case 112 provides a compressor flow path 130 from the bypass flow path 18 to the first compressor stage. The outer shroud 72 is secured to the first inlet flange 116 at the first attachment feature 86 with fasteners 107. The inner shroud 70 is secured to the second inlet flange 118 at the third attachment feature 96 with fasteners 129.

A splitter 120 is secured over the outer shroud 72 to the second attachment feature 88 with fasteners 121. The splitter 120 includes an annular groove 122 arranged opposite the second attachment feature 88. The outer shroud 72 includes a lip 124 opposite the first flange 84 that is received in the annular groove 122. A projection 126 extends from an inside surface of the splitter 120 and is arranged in close proximity to, but spaced from, an edge 128 of the outer ends 78 to prevent undesired radial outward movement of the stator vanes 74 from the outer shroud 72. The inner and outer shrouds 70, 72 and splitter 120 are constructed from an aluminum 6061 alloy in one example.

Figure 5A:
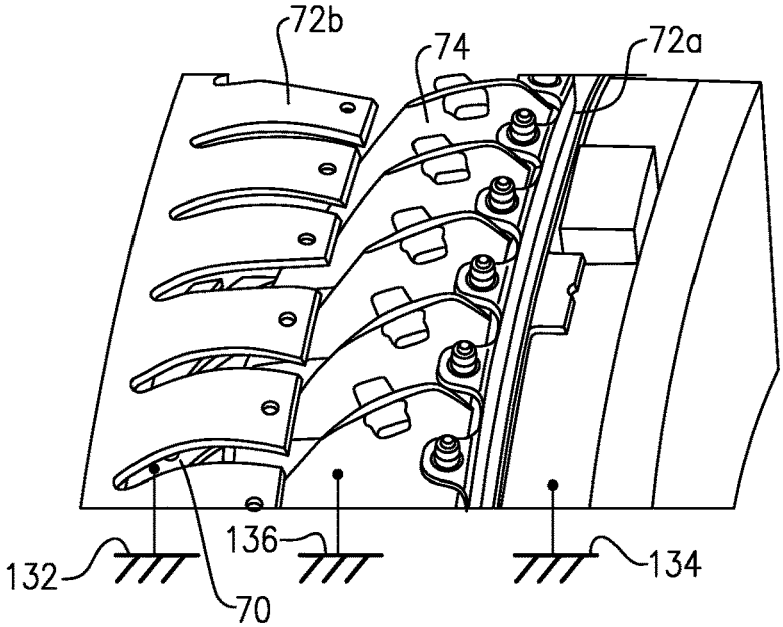
FIG. 5A is one step in a stator vane assembly process.
Figure 5B:
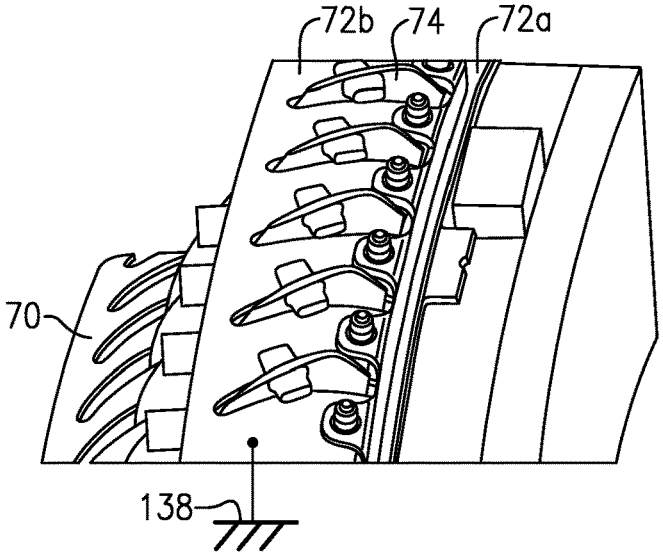
FIG. 5B is another step in the stator vane assembly process.

Referring to FIGS. 5A and 5B, the front architecture 36 is assembled by positioning the inner shroud 70 and first shroud portion 72*a* relative to one another with first and second fixtures 132, 134. In the example stator vane assembly, the inner ends 76 are larger than the outer ends 78 such that the stator vanes 74 cannot be inserted through the first shroud 72 radially inwardly during assembly. The stator vanes 74 are arranged circumferentially and suspended between the inner shroud 70 and first shroud portion 72*a* and located with a third fixture 136. The second shroud portion 72*b* is slid axially over the stator vanes 74 and rotated circumferentially such that the outer ends 78 are received in the second slots 80. The second shroud portion 72*b* is located with a fourth fixture 138.

The stator vanes 74 are mechanically isolated from the inner and outer shrouds 70, 72, and the first and second shroud portions 72*a*, 72*b* are secured to one another. The liquid sealant is applied and layed in the gaps 101, 109 (shown in FIG. 3), which are maintained during the sealing step, to vibrationally isolate the stator vanes 74 from the adjoining structure. The sealant adheres to and bonds the stator vanes and the inner and outer shrouds to provide a flexible connection between these components. In the example arrangement, there is no direct mechanical engagement between the stator vanes and shrouds. The sealant provides the only mechanical connection and support of the stator vanes relative to the shrouds.

Since the sealant bonds the stator vanes to the inner and outer shrouds, the stator vane ends are under virtually no moment constraint such that there is a significant reduction in stress on the stator vanes. No precision machined surfaces are required on the stator vanes for connection to the shrouds. In one example, a stress reduction of over four times is achieve with the disclosed configuration compared with stator vanes that are mechanically supported in a conventional manner at one or both ends of the stator vanes. As a result of being subjected to considerably smaller loads, lower cost, lighter materials can be used, such as an aluminum 2014 alloy, which is also more suitable to forging. Since the liquid sealant is applied after the stator vanes 74 have been arranged in a desired position, any imperfections or irregularities in the slots or stator vane perimeters are accommodated by the sealant, unlike prior art grommets that are preformed.

Although an example embodiment has been disclosed, a worker of ordinary skill in this art would recognize that certain modifications would come within the scope of the claims. For that reason, the following claims should be studied to determine their true scope and content.

What is claimed is:

1. A method of assembling gas turbine engine front architecture comprising the steps of:

positioning a first shroud and a first shroud portion radially relative to one another;

arranging multiple vanes circumferentially between the first shroud and the first shroud portion to extend between tabs extending axially from the first shroud portion;

arranging a second shroud portion having axially extending second slots by sliding the second shroud portion axially over the vanes such that the vanes pass through open axial ends of the second slots and the first shroud portion covers the open axial ends of the second slots;

securing the second shroud portion to the first shroud portion about the vanes, the first and second shroud portions providing a second shroud; and mechanically isolating the vanes from the first shroud and the second shroud.

2. The method according to claim 1, wherein the first shroud and the second shroud respectively correspond to inner and outer shrouds.

3. The method according to claim 2, wherein the arranging multiple vanes step includes inserting the vanes into first slots provided in the first shroud, and wherein the step of mechanically isolating the vanes includes applying a liquid sealant around a perimeter of the vanes and at least one of the shrouds, and bonding and supporting the ends of vanes relative to one of the shrouds with the liquid sealant.

4. The method according to claim 3, wherein each of the multiple vanes includes outer and inner perimeters respectively received in the first and second slots, and the arranging multiple vanes step includes providing gaps between the outer and the inner perimeters and the outer and inner shrouds at their respective first and second slots, wherein the applying step includes laying the liquid sealant about at least one of the inner and outer perimeters within their respective gaps.

5. The method according to claim 4, wherein the inner perimeters are suspended relative to the inner shroud by the liquid sealant without direct contact between the vanes and the inner shroud.

6. The method according to claim 4, wherein the outer perimeters are suspended relative to the outer shroud by the liquid sealant without direct contact between the vanes and the outer shroud.

7. The method according to claim 4, wherein the gaps are maintained during the applying step.

8. The method according to claim 3, wherein the liquid sealant is silicone rubber provided in one of a thicksotropic formulation or a room temperature vulcanization formulation, the liquid sealant providing a solid seal in a cured state.

9. The method according to claim 1, wherein the securing step includes moving the second shroud portion axially and circumferentially with respect to the first shroud portion, and fastening the first and second shroud portions to one another about the vanes.

10. The method of claim 1, wherein the arranging a second shroud portion step includes arranging the second shroud portion to at least partially surround the first shroud portion.

11. The method of claim 10, wherein the arranging a second shroud portion step includes arranging the second shroud portion such that tabs on the second shroud portion extend laterally over the first shroud portion.

12. The method of claim 11, wherein the securing step includes fastening the first shroud portion and the second shroud portion to each other with fasteners extending through the tabs.

13. A gas turbine engine front architecture comprising:

first and second shrouds, and respectively including first and second walls having first and second slots respectively, the second shroud including first and second shroud portions, wherein the first and second shroud portions are secured to one another by fasteners;

wherein each second slot extends across part of the second shroud portion and has an open axial end and a closed axial end, the closed end being an axially opposite end of the second slot from the open axial end, and the open axial end being located at an edge of the second shroud portion, and the first and second shroud portions are secured to one another such that the first shroud portion covers the open axial ends; and multiple stator vanes circumferentially spaced from one another, each of the stator vanes extending radially between the first and second shrouds and including outer and inner perimeters respectively within the first and second slots.

14. The gas turbine engine front architecture according to claim 13, wherein the first shroud portion includes tabs that extend laterally over the second shroud portion.

15. The gas turbine engine front architecture according to claim 14, wherein the first and second shroud portions are secured to one another by fasteners extending through the tabs.

16. The gas turbine front engine front architecture according to claim 13, wherein the edge of the first shroud portion is an axial edge, and the open end is an axial end of the second slot.

17. A gas turbine engine front architecture comprising:

first and second shrouds, and respectively including first and second walls having first and second slots respectively, the second shroud including first and second shroud portions, wherein each second slot extends across part of the second shroud portion and has an open axial end and a closed axial end, the closed end being an axially opposite end of the second slot from the open axial end, and the open axial end being located at an edge of the second shroud portion, and the first and second shroud portions are secured to one another such that the first shroud portion covers the open axial ends;

multiple stator vanes circumferentially spaced from one another, each of the stator vanes extending radially between the first and second shrouds and including outer and inner perimeters respectively within the first and second slots, and a flexible material provided about the inner and the outer perimeters at the inner and the outer shrouds bonding the stator vanes to the inner and outer shrouds and separating the stator vanes mechanically from the inner and outer shrouds.

18. The gas turbine engine front architecture according to claim 17, comprising an inlet case including first and second inlet flanges integrally joined by inlet vanes, the second and first shrouds corresponding to outer and inner shrouds that are respectively fastened to the first and second inlet flanges, multiple stator vanes upstream from the inlet vanes, wherein the flexible material is a sealant.

19. The gas turbine engine front architecture according to claim 18, wherein the outer shroud includes an attachment feature secured to the first inlet flange and a lip opposite the attachment feature, and comprising a splitter including an annular groove supporting the lip.

20. The gas turbine engine front architecture according to claim 19, wherein the splitter includes a projection facing each stator vane in close proximity to an edge of the outer end configured to limit radial movement of the stator vanes.

21. A gas turbine front engine architecture comprising:

a first shroud and a second shroud, the first shroud having a radial, spaced apart relationship with the second shroud, the first shroud including a first shroud portion and a second shroud portion, the first shroud portion defining first slots and the second shroud portion defining second slots;

multiple stator vanes circumferentially spaced form one another, each of the stator vanes extending radially between the first shroud and the second shroud and being fitted in the corresponding first slots and the corresponding second slots, outer and inner perimeters being associated with each of the first slots and the second slots; and the second shroud portion further defining third slots therethrough such that each third slot of the second shroud portion has at least one open end that opens out at a peripheral edge of the second shroud portion;

wherein the second shroud portion is received to engagingly overlie the first shroud portion in a manner so that the first shroud portion closes the open end of each third slot of the second shroud portion.

* * * * *